United States Patent [19]

Vandenberg

[11] Patent Number: 4,705,590

[45] Date of Patent: Nov. 10, 1987

[54] MACHINE FOR ADHESIVELY MOUNTING A PRINTING PLATE ON A PLATE ROLL

[76] Inventor: Edward Vandenberg, 1621 Dana Ave., Cincinnati, Ohio 45207

[21] Appl. No.: 929,598

[22] Filed: Nov. 12, 1986

[51] Int. Cl.[4] ..... B41F 27/12

[52] U.S. Cl. ..... 156/447; 101/415.1; 101/DIG. 12; 33/618

[58] Field of Search ..... 101/378, 415.1, DIG. 12; 33/618, 621; 156/215, 218, 446, 447

[56] References Cited

U.S. PATENT DOCUMENTS

| | | | |
|---|---|---|---|
| 3,113,898 | 12/1963 | Tross | 156/215 |
| 3,186,336 | 6/1965 | Kirby | 101/DIG. 12 |
| 3,358,598 | 12/1967 | Middleton | 101/378 |
| 3,515,617 | 6/1970 | Schaeffer | 101/DIG. 12 |
| 3,616,055 | 10/1971 | Mages | 156/215 X |
| 3,773,594 | 11/1973 | Aaron et al. | 156/447 X |
| 4,046,072 | 9/1977 | Henderson | 101/DIG. 12 |
| 4,446,625 | 5/1984 | Hagan et al. | 33/618 X |
| 4,451,309 | 5/1984 | Cauldwell | 156/215 X |
| 4,589,338 | 5/1986 | Collins et al. | 101/415.1 X |
| 4,611,539 | 9/1986 | Ireton | 101/415.1 X |

*Primary Examiner*—Clifford D. Crowder
*Attorney, Agent, or Firm*—James W. Pearce; Roy F. Schaeperklaus

[57] ABSTRACT

A machine for mounting a printing plate on a plate roll having an adhesively coated face. The machine includes a frame, means for rotatably mounting a plate roll on the frame in a selected position, a tilting framework swingably mounted on the frame and a pair of table sections mounted on the tilting framework on which the printing plate can be slideably mounted. A transparent grid plate is hingedly mounted on the tilting framework and can overlie the printing plate on the table sections. The printing plate can be advanced across the table section until the grid shows that the printing plate is properly aligned with the plate roll. Then a movable one of the table sections can be withdrawn and the printing plate can be advanced downwardly to bring a portion of the printing plate into engagement with the plate roll for attaching the printing plate to the plate roll. The plate roll can be turned to bring the rest of the printing plate into engagement with the adhesively coated face of the plate roll.

4 Claims, 21 Drawing Figures

MACHINE FOR ADHESIVELY MOUNTING A PRINTING PLATE ON A PLATE ROLL

BACKGROUND OF THE INVENTION

This invention relates to a machine for mounting a printing plate on a plate roll of a printing machine.

An object of this invention is to provide a machine which rotatably supports a plate roll while a printing plate is moved into alignment with the plate roll.

A further object of this invention is to provide such a machine which permits attachment of the printing plate to the plate roll in proper circumferential, angular, and transverse relation with the plate roll.

BRIEF STATEMENT OF THE INVENTION

Briefly, this invention provides a machine having a frame which includes means for rotatably mounting a plate roll in a selected position. A tilting framework is swingably mounted on the frame. The tilting framework carries table sections on which the printing plate can be slideably mounted. At least one of the table sections is slideably mounted for movement between a printing plate support position and a retracted position. A transparent grid sheet is hingedly mounted on the tilting framework and can overlie the printing plate on the table sections. The printing plate can be advanced across the table sections until the grid shows that the printing plate is properly aligned with the plate roll. The movable table section is withdrawn and the printing plate is advanced downwardly to bring a portion of the printing plate into engagement with the plate roll. The plate roll can then be rotated to bring the rest of the printing plate into engagement with a surface of the plate roll. This surface has an adhesive coating which holds the printing plate.

The above and other objects and feature of the invention will be apparent to those skilled in the art to which this invention relates from the following detailed description and the drawings in which:

BRIEF DESCRIPTION OF THE DRAWINGS

In the following detailed description and the drawings, like reference characters indicate like parts.

DESCRIPTION OF PRESENTLY PREFERRED EMBODIMENT

Figure 1:
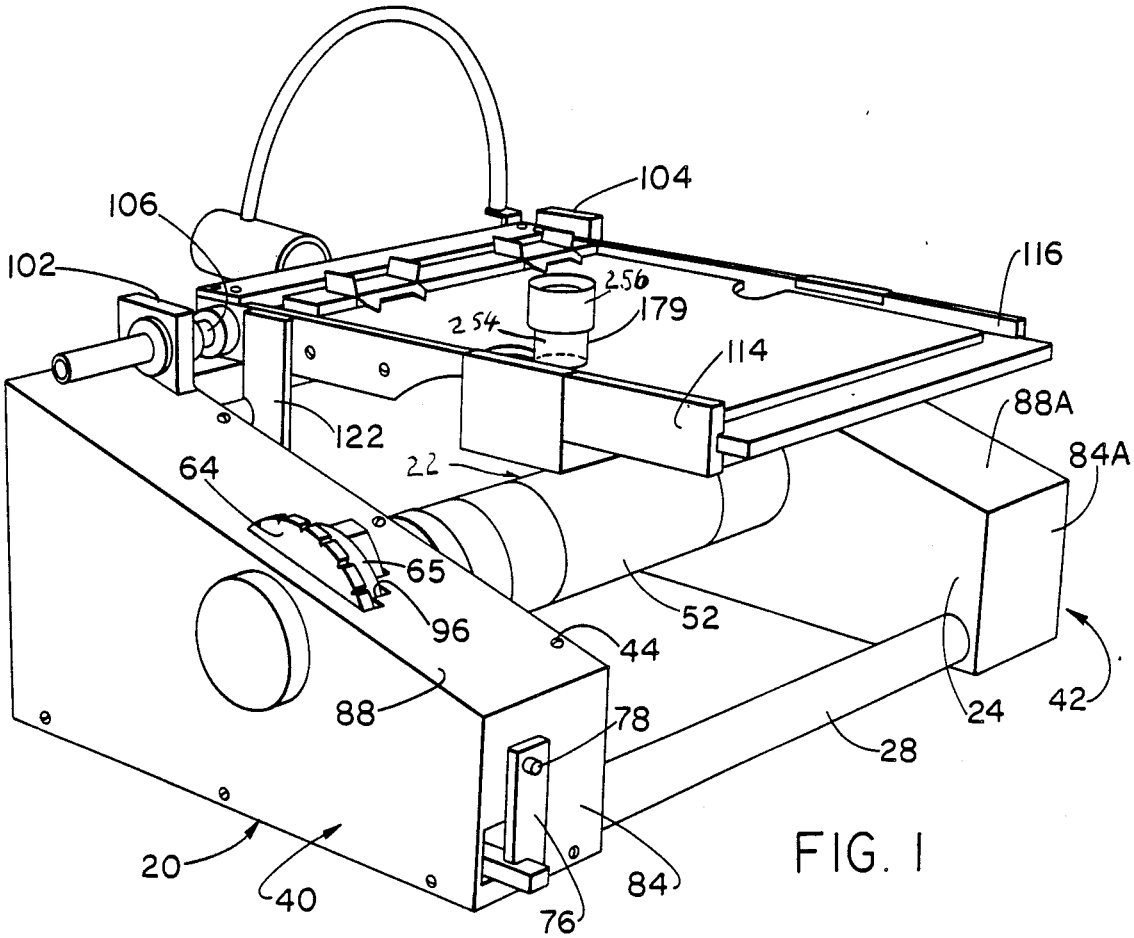
FIG. 1 is a perspective view of a machine for mounting a printing plate on a plate roll, the machine being constructed in accordance with an embodiment of this invention.

In FIG. 1 is shown a machine 20 for mounting a printing plate 21 (FIGS. 7 and 8) on a plate roll 22. The machine 20 includes two spaced parallel main frame plates 23 (FIG. 2) and 24 (FIG. 1) between which the plate roll 22 is rotatably mounted.

The main frame plates 23 and 24 are held in assembled relation by rods 28, 30 and 32. The rods 28, 30 and 32 are provided with axial sockets 34 (FIG. 2A) in which bolt fasteners 36 are threaded. The bolt fasteners extend through clear holes 38 in the frame plates 23 and 24. Box frame members 40 and 42 are mounted on the main frame plates 23 and 24, respectively, by fasteners 44. Horizontal frame plates 46 and 48 close lower sides of the box frame members 40 and 42, respectively. The horizontal frame plates 46 and 48 are attached to the main frame plates 23 and 24, respectively, by fasteners 421.

Figures 12, 13:
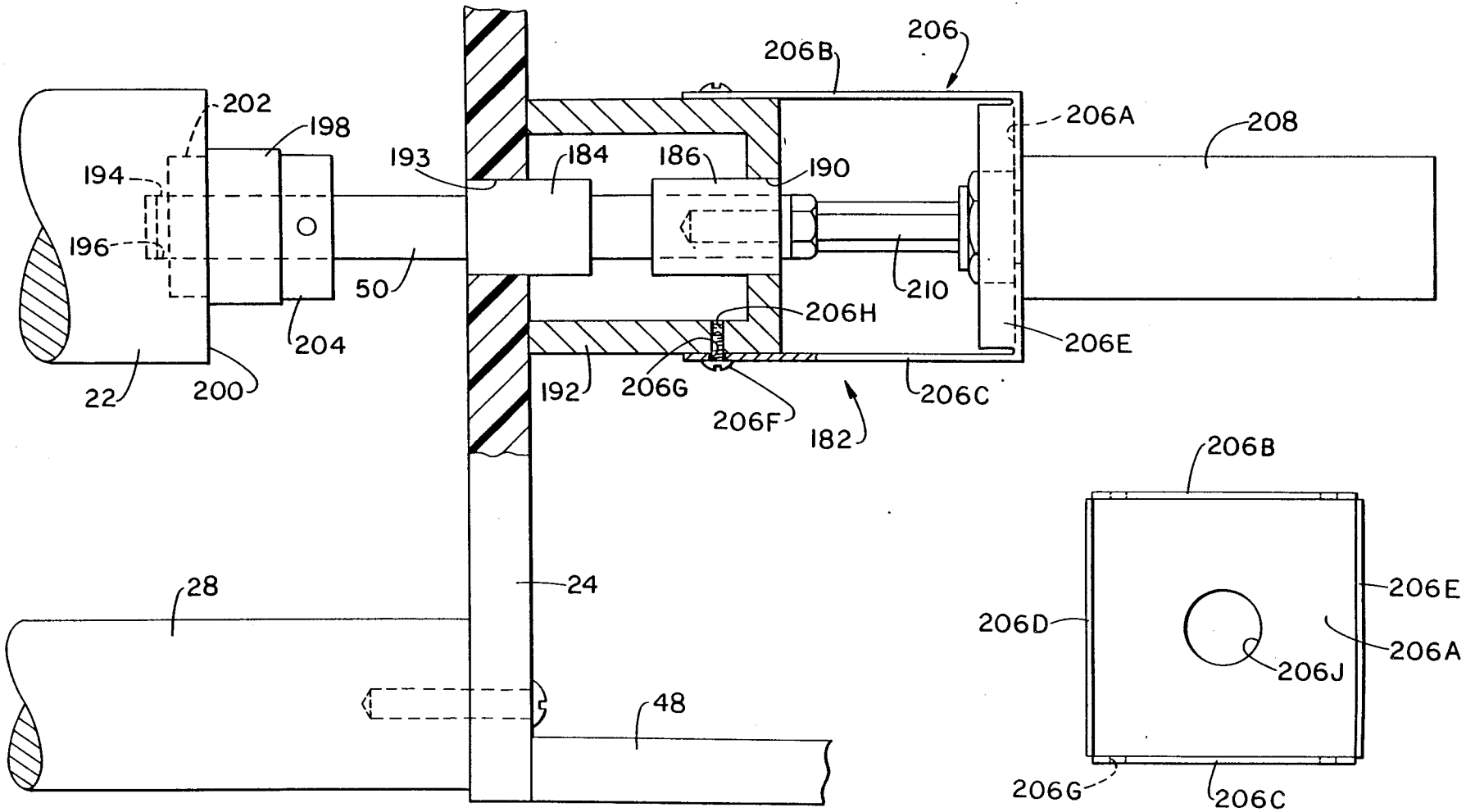
FIG. 12 is a sectional view of a device for holding one end of the plate roll.
FIG. 13 is a view in side elevation of a bracket of the device for holding the plate roll.

The plate roll 22 is supported by stub shafts 49 (FIG. 2A) and 50 (FIG. 12). A gear 51 is mounted on the plate roll 22. A face 52 (FIG. 1) of the plate roll 22 is provided with a pressure sensitive coating, not shown in detail.

Figure 2:
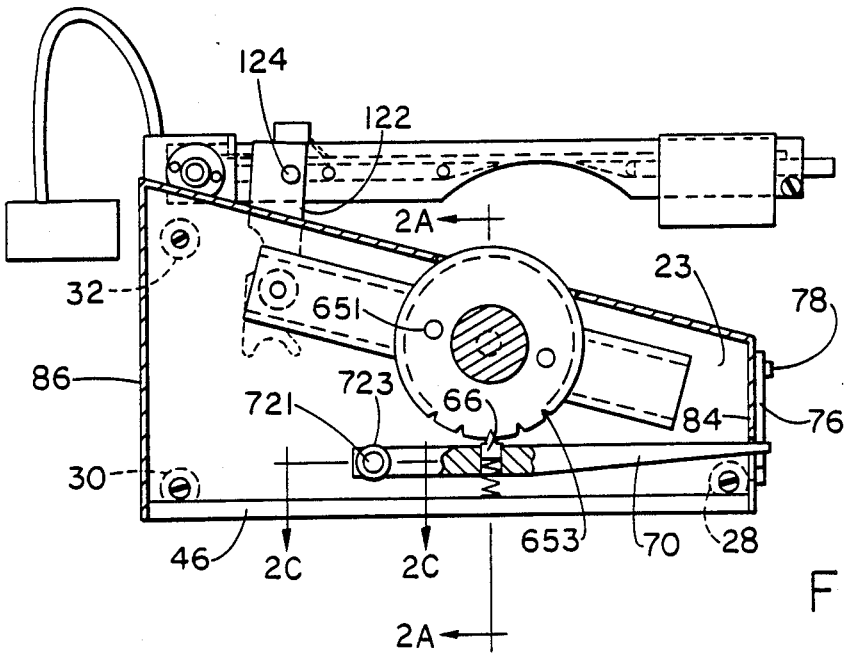
FIG. 2 is a view in upright section of the machine illustrated in FIG. 1.

The stub shaft 49 is rotatably mounted in bearings 521 and 522. A first shaft support channel 54 is attached to the main frame plate 23 by fasteners 55. The bearings 521 and 522 are mounted in openings in the first shaft support channel 54 and the frame plate 23, respectively, to support the stub shaft 49 for turning movement. The stub shaft 49 carries a handle 60, which can be used to turn the plate roll 22. A set screw 61 mounted on the handle 60 engages a flat 62 on the shaft 49. Discs 64 and 65 turn with the handle 60. Fasteners 651 attach the discs 64 and 65 to turn together. A key 652 causes the discs 65 and 64 to turn with the shaft 49. Slots 653 arranged around the circumference of the disc 64 can receive a detent 66 for locking the plate roll 22 in selected position. The detent 66 is mounted in a bore 68 in a lever 70. The lever 70 is swingably mounted on a post 72. The post 72 is supported on the main frame plate 23. A journal extension 721 of the post 72 is received in a bearing opening 722 of the lever 70. A collar 723 attached to the journal extension 721 holds the lever 70 in position. A compression spring 74 is received in the bore 68 in the lever 70 and bears on the frame plate 46 to urge the lever 70 upwardly as shown in FIG. 2. An index lever latch 76 can hold the lever 70 in locking position. The index lever latch 76 is pivotally mounted on a pivot pin 78 carried by the box frame member 40. A slot 80 in the index lever latch 76 receives an end portion of the lever 70.

Figure 4:
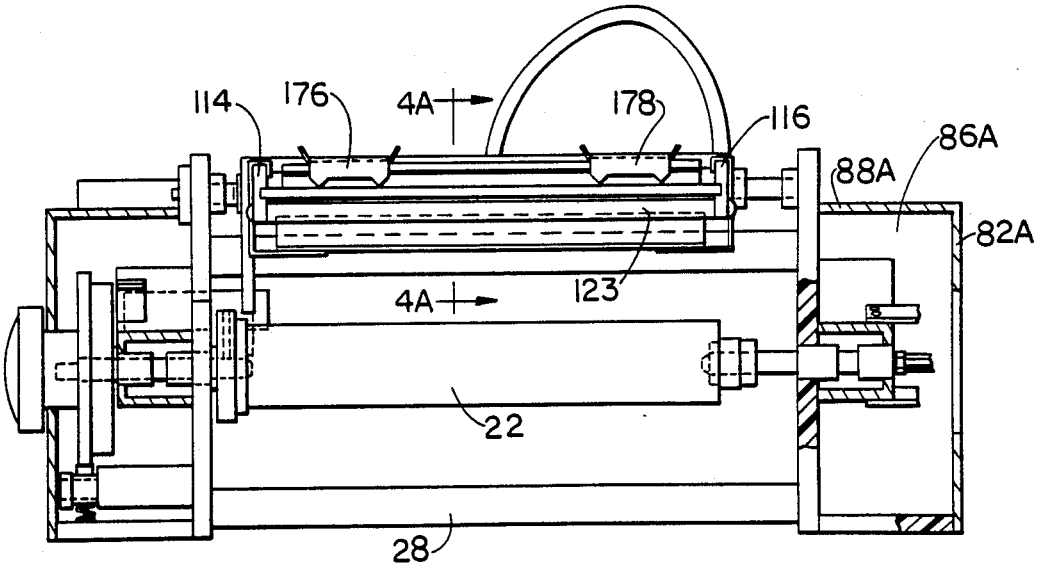
FIG. 4 is an end elevational view of the machine with the box frame members being broken away.

The box frame member 40 (FIG. 1) includes a first upright plate portion 82, a second upright plate portion 84, a third upright plate portion 86, and a sloping plate portion 88. The fasteners 44 attach the box frame member 40 to the frame plate 23. The box frame member 42 (FIG. 1) similarly includes upright plate portions 82A (FIG. 4), 84A and 86A and a sloping plate portion 88A.

The discs 64 and 65 extend through an opening 96 (FIG. 2A) in the sloping plate portion 88. An index bracket 961 is mounted on the first shaft support channel 54 and includes a portion 962, which is exposed above the sloping plate portion 88 to provide indexing indicia (not shown in detail) for the discs 64 and 65. Feet 963 of the index bracket 961 are attached to the channel 54 by fasteners 964.

Figure 2A:
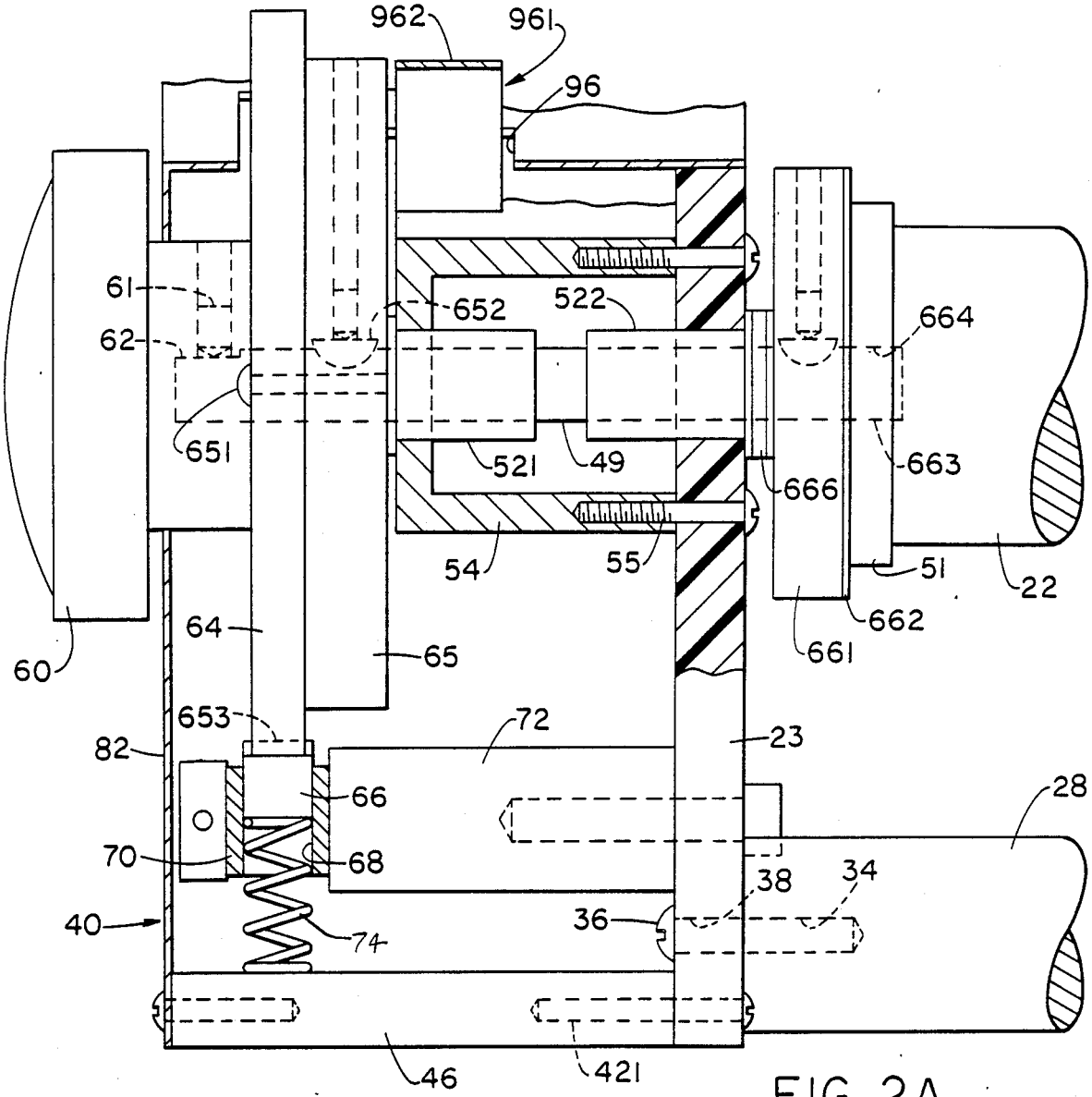
FIG. 2A is a view in section taken on an enlarged scale on the line 2A—2A in FIG. 2.
Figure 2B:
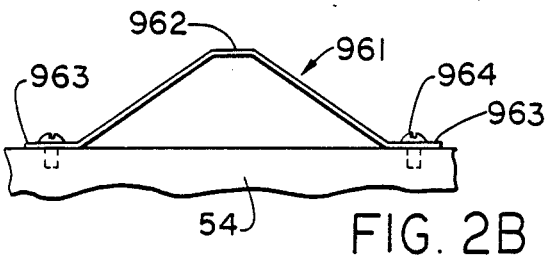
FIG. 2B is a view in side elevation of an index pointer member of the machine, together with a fragmentary portion of a first shaft support channel.
Figure 2C:
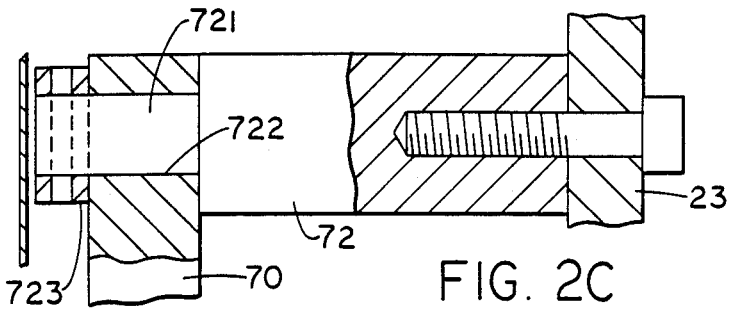
FIG. 2C is a view in section taken on an enlarged scale on the line 2C—2C in FIG. 2.
Figure 2D:
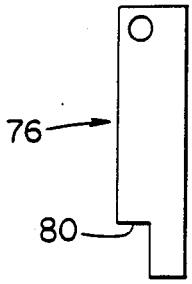
FIG. 2D is a view in side elevation of an index lever latch of the machine.

A disc 661 (FIG. 2A) is mounted on and keyed to the stub shaft 49. A right hand face of the disc 661 carries an abrasive facing 662 which can engage the gear 51 so that the plate roll 22 can be turned when the handle 60 is turned, but the plate roll 22 can be turned with reference to the discs 64 and 65 to bring the plate roll 22 into proper alignment with the disc 64 and the slots thereon. A tip end portion 663 of the stub shaft 49 is received in a socket 664 in the gear 51. As the plate roll 22 is urged to the left as shown in FIG. 2A, the disc 661 rides against a thrust bearing 666, which is backed up by the main frame plate 23.

Figure 3:
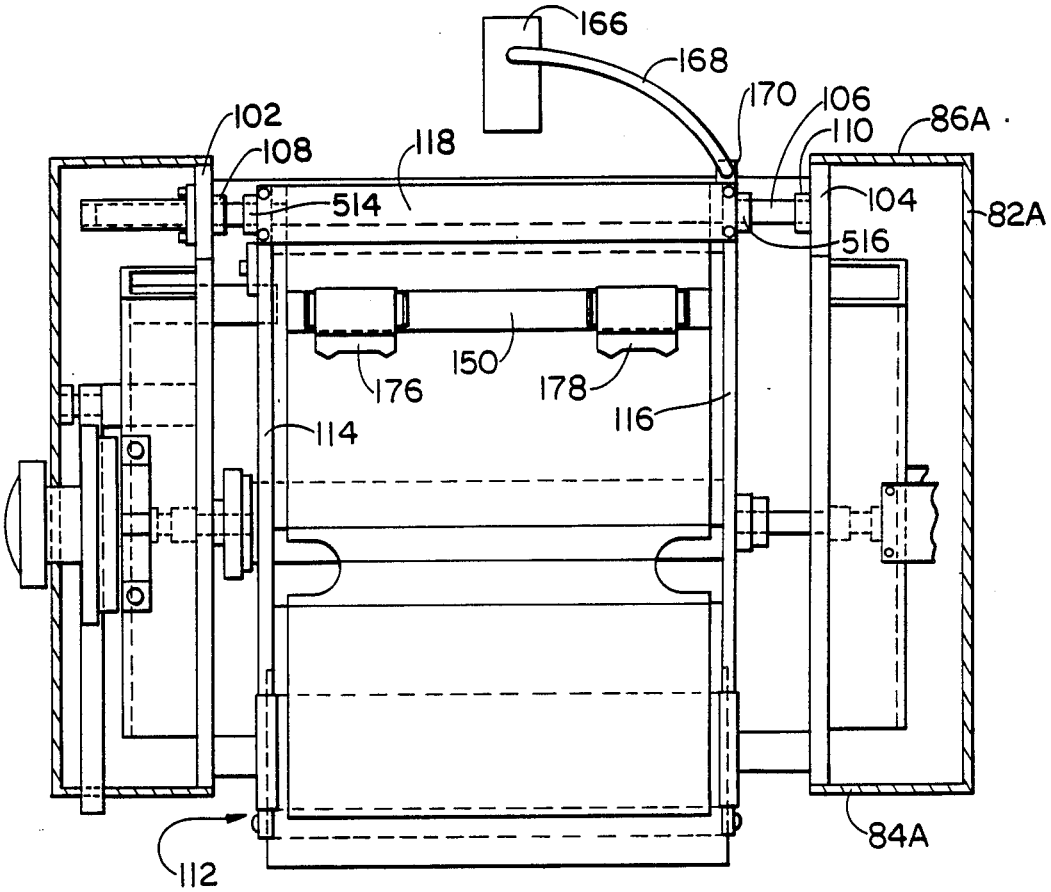
FIG. 3 is a plan view of the machine with box frame members broken away and in section.
Figure 9:
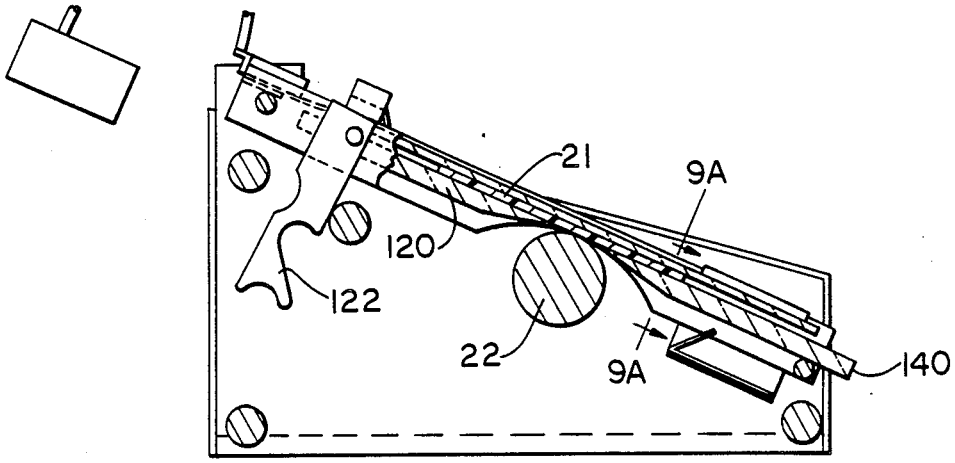
FIG. 9 is a somewhat schematic sectional view showing the operating framework in lowered position for affixing the printing plate to the plate roll.
Figure 9A:
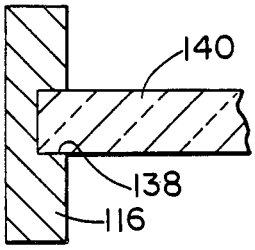
FIG. 9A is a view in section taken on an enlarged scale on the line 9A—9A in FIG. 9.

Upper rear corner portions 102 and 104 of the frame plates 23 and 24, respectively, extend upwardly above the sloping plate portions 88 and 88A, respectively, and form supports for a cross shaft 106 (FIG. 3). Collars 108 and 110 attached to the cross shaft 106 hold the cross shaft 106 in position. A tilting framework 112 is pivotally mounted on the cross shaft 106. The tilting framework 112 includes two side frame arms 114 and 116. The side frame arms 114 and 116 (FIG. 4) are joined by an upper tie plate 118, which is attached to and spans the side frame arms 114 and 116. Fasteners 119 (FIG. 4B) attach the upper tie plate 118 to the side frame arms 114 and 116. A first table section 120 is also attached to and spans the side frame arms 114 and 116 to hold the side arms in assembled relation. Fasteners 121 attach the first table section 120 to the side frame arms 114 and 116. A cross rod 123 (FIG. 4A) holds outer end portions of the side frame arms 114 and 116 in spaced relation. Collars 514 and 516 (FIG. 3) mounted on the cross shaft 106 hold the tilting framework 112 in position on the cross shaft 106. A support crank 122 is rotatably mounted on a pin 124. The pin 124 is mounted in the side frame arm 114. The support crank 122 is provided with slots 126 and 128 (FIGS. 5 and 6), which can receive a cross bar 130. The cross bar 130 is supported on and spans the main frame plates 23 and 24. When the crank slot 126 overlies the shaft 130, the tilting framework 112 is supported in a raised position shown in FIG. 5. When the crank slot 128 overlies the shaft 130, the tilting framework 112 is supported in a horizontal position shown in FIG. 6. When the support crank 122 is released from the shaft 130, the tilting framework 112 can descend to a lowered position shown in FIGS. 9–11 in which slots 132 and 134 (FIGS. 5 and 6) in the side frame arms 114 and 116, respectively, receive the plate roll 22 (FIG. 9).

Figure 4A:
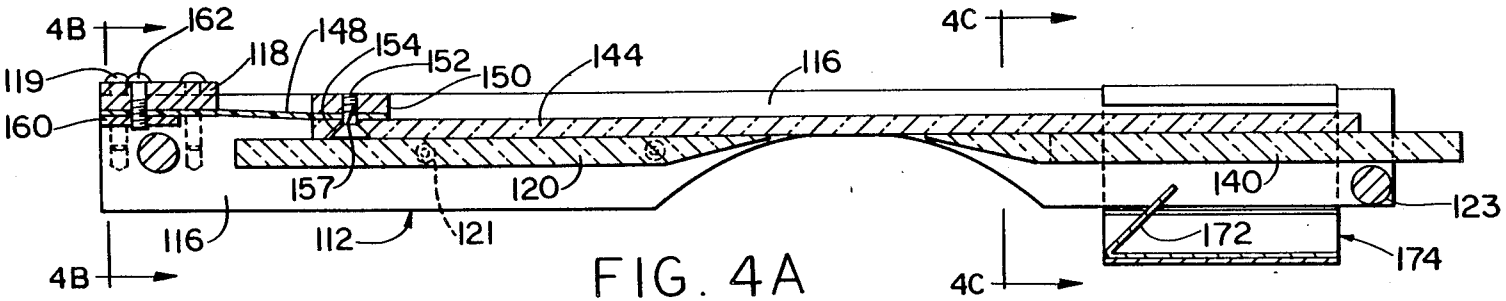
FIG. 4A is a view in section taken generally on the line 4A—4A in FIG. 4, some portions being omitted for clarity.
Figure 4B:
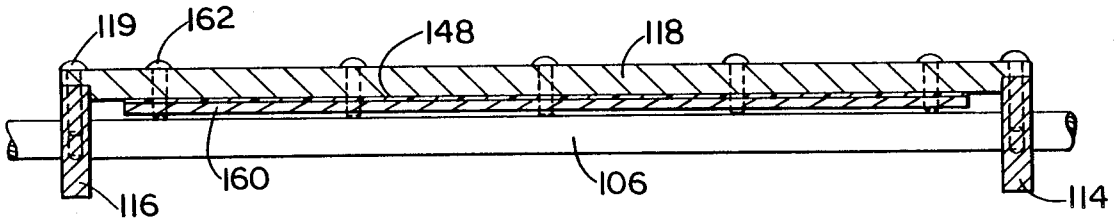
FIG. 4B is a view in section taken on the line 4B—4B in FIG. 4A.
Figure 4C:
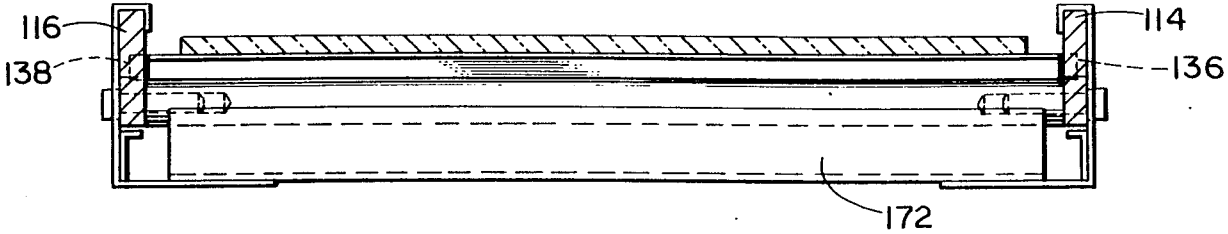
FIG. 4C is a view in section taken on the line 4C—4C in FIG. 4A.
Figure 5:
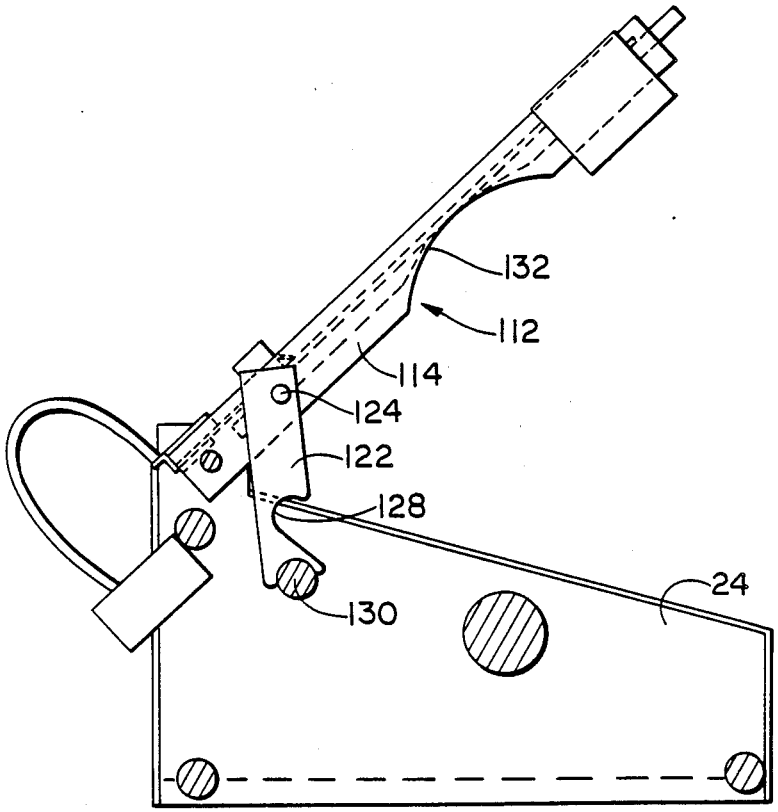
FIG. 5 is a somewhat schematic sectional view in upright section showing the machine with a tilting framework raised.

The side frame arms 114 and 116 (FIG. 4C) are provided with slots 136 and 138, respectively. The slots 136 and 138 slideably receive a sliding second table section 140 (FIG. 4A). The second table section 140 has lengthwise edge portions, which are received in the slots 136 and 138. Upper faces of the table sections 120 and 140 are coplanar and provide a level but broken surface for supporting the printing plate 21 (FIGS. 8–11) and on which the printing plate 21 can be slid to properly position the printing plate 21 for registry of indicia on the printing plate 21 with the plate roll 22. A sheet of transparent plastic material 142 (FIG. 7) can be positioned on top of the printing plate 21 to cover printing indicia (not shown) on the printing plate 21 and to ease sliding of the printing plate 21.

Figure 6:
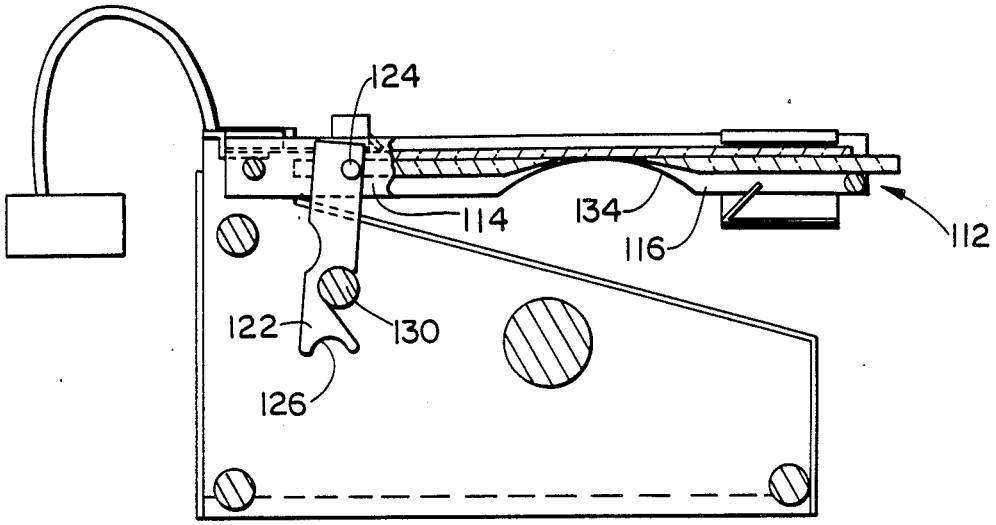
FIG. 6 is a somewhat schematic sectional view with the tilting framework in horizontal position.

A transparent plastic sheet 144 bearing grid markings 146 (FIG. 8) can be hinged to the tilting framework 112. The plastic grid sheet 144 is mounted by means of a flexible hinge strip 148 of nylon or the like. A hold-down plate 150 overlies one edge portion of the strip 148. Fasteners 152 (FIG. 4A) extend through countersunk openings 154 in the plastic grid sheet 144 and through openings 156 (FIG. 8) in the hinge strip 148 to be threaded in openings 157 in the hold-down plate 150 to attach the hinge strip 148 to the grid sheet 144. An opposite edge portion of the hinge strip 148 is gripped between the upper tie plate 118 and a lower tie plate 160. Fasteners 162 hold the upper tie plate 118 and the lower tie plate 160 in assembled relation gripping the hinge strip 148. When unimpeded access to the printing plate 21 is required, the grid sheet 144 can be swung upwardly to the FIG. 7 position. When the grid sheet 144 is lowered as shown in FIG. 6, access to the printing plate 21 can be had through finger openings 163 and 164 in the grid sheet 144 as shown in FIG. 8, as well as the space between the adjacent ends of table portions 120 and 140 (FIG. 4A).

The grid sheet 144, the table sections 120 and 140, and the plastic sheet 142 can all be transparent so that light from a lamp 166 can be directed therethrough. The lamp 166 (FIG. 7) is supported on a flexible stem 168. The flexibles tem 168 is supported by a bracket 170 attached to the upper tie plate 118. The lamp 166 directs light against a mirror plate 172 (FIG. 4A) so that the light is projected through the grid sheet 144 thereabove. The mirror plate 172 is mounted on a support frame 174, which hangs from the side frame arms 114 and 116. Guide elements 176 and 178 (FIGS. 3 and 4) are mounted on the hold-down plate 150 and can be used to indicate portions of the design on the grid sheet 144 which are used in aligning the printing plate 21 on the machine. A lens assembly 179, such as that known as a Peak Scale Lupe 10X, can be used to check alignment of the printing plate 21 with the grid sheet 144. As the grid marks are adjacent the under face of grid sheet 144, the length of transparent hollow cylindrical barrel 254 of lens assembly 179 may be shortened in view of the thickness of grid sheet 144 so as to place the grid marks and the subjacent indicia of plate 21 at distances within the depth of the focus of the lens mounted in lens mount 256 mounted on cylindrical barrel 254 adjacent its upper end. The lower end of cylindrical barrel 254 of lens assembly 179 is supported on grid sheet 144 and the assembly not only provides magnification of, but also assists in viewing the grid and plate on a line of sight perpendicular to the grid and plate to minimize error in alignment of the grid and plate as might result from viewing different portions of the grid and plate along non-parallel lines of sight incident to positioning the plate as described hereinafter.

The right hand end portion of the plate roll 22 is supported by an assembly 182 shown most clearly in FIG. 12. The stub shaft 560 is mounted for slidig movement in bearings 184 and 186. The bearing 186 is supported in an opening 190 in a second shaft support channel 192. The bearing 184 is mounted in an opening 193 in the main frame plate 24. A left hand end portion 194 of the second stub shaft 50 is received in a socket 196 in the plate roll 22. A head ring 198 mounted on the second stub shaft 50 is engageable with an end face 200 of the plate roll 22. Collars 202 and 204 mounted on the second stub shaft 50 prevent movement of the head ring 198 along the second stub shaft 50. A bracket 206 is mounted on the second shaft support channel 192. The bracket 206 includes a main plate portion 206A, side wall portions 206B and 206C and narrow side stiffening members 206D and 206E. Fasteners 206F extend through clear holes 206G in the side wall portions 206B and 206C to be received in threaded openings 206H in the second shaft support channel 192. A central opening 206J is provided in the main plate portion 206A. An air cylinder 208 is mounted on the bracket 206. A rod 210 of the cylinder 208 is attached to the stub shaft 50. When the rod 210 is retracted, the stub shaft 50 and the head ring 198 are withdrawn to permit release of the plate roll 22. When the rod 210 is extended, the stub shaft 50 enters the plate roll 22 and the head ring 198 engages the end face 200 of the plate roll 22 to urge the plate roll 22 to the left to mount the plate roll 22 in the machine.

Figure 7:
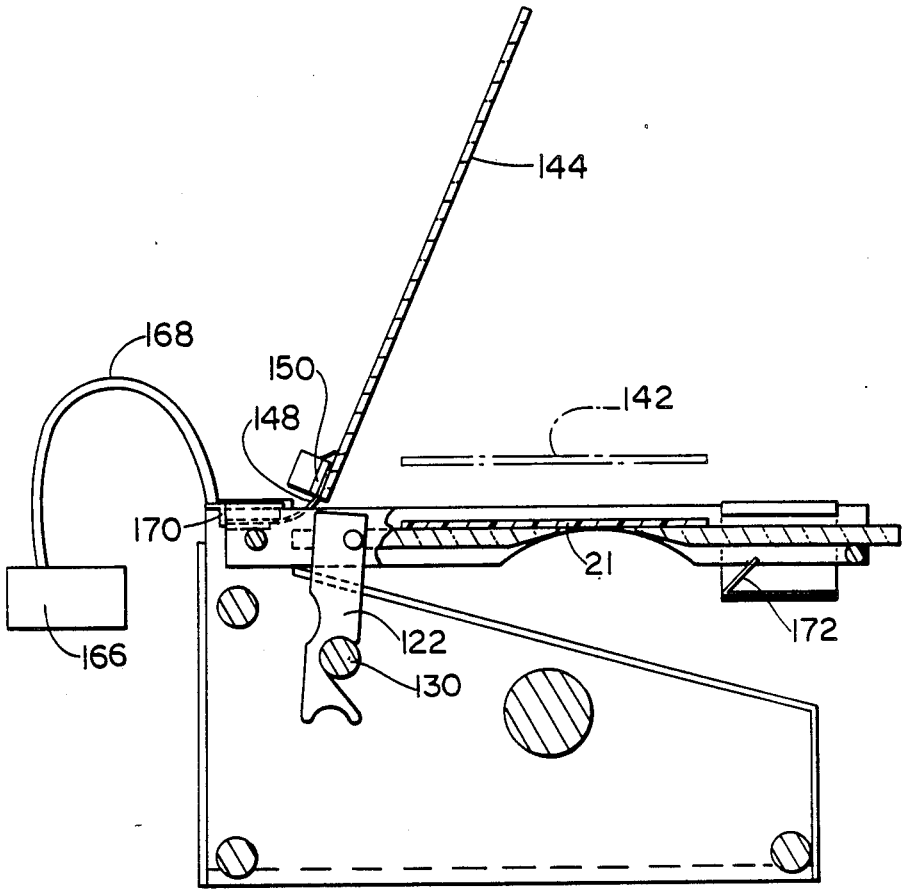
FIG. 7 is a somewhat schematic sectional view showing the tilting framework in horizontal position and a transparent grid sheet in raised position, a printing plate being shown on a sectional table of the machine.
Figure 8:
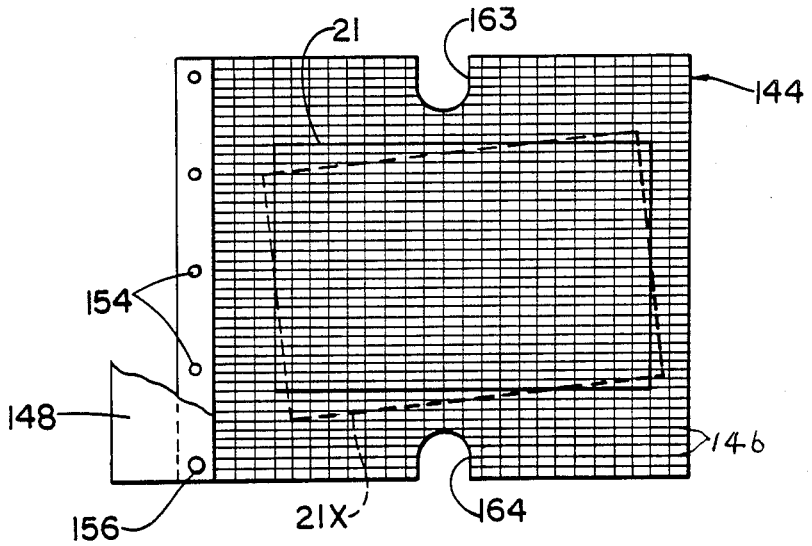
FIG. 8 is a schematic view showing a portion of a flexible hinge in association with a transparent grid sheet overlying the printing plate, a first position of the printing plate being shown in dashed lines, a corrected second position of the printing plate being shown in full lines.
Figure 10:
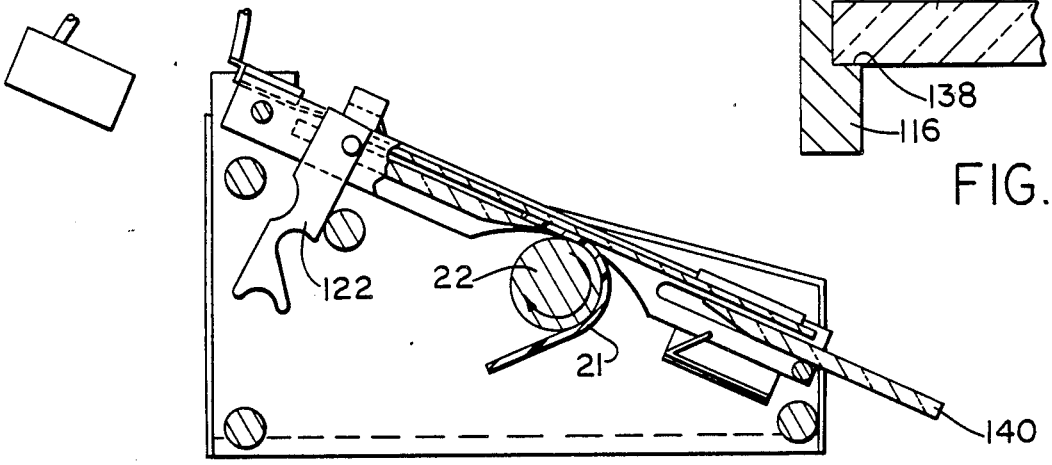
FIG. 10 is a somewhat schematic sectional view showing the printing plate partly applied to the plate roll.
Figure 11:
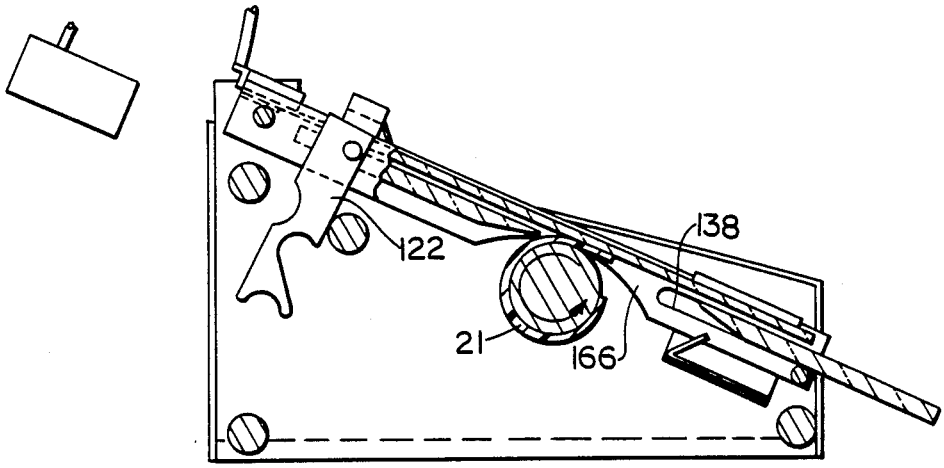
FIG. 11 is a somewhat schematic sectional view showing the printing plate nearly completely applied to the plate roll.

When the plate roll 22 has been mounted in the machine, the printing plate 21 is mounted on the table sections 120 and 140 as shown in FIG. 7. The transparent sheet 142 is mounted on the printing plate 21 overlying indicia thereon so that there is minimum resistance to sliding the printing plate 21 under the grid sheet 144. The grid sheet 144 is lowered from the FIG. 7 position to the FIG. 6 position. The operator's fingers can be extended through the openings 162 and 164 in the grid sheet 144, as well as the space between the adjacent ends of table sections 120 and 140 to grip the printing plate 21 to move the printing plate 21 from an incorrect position shown at 21X in dashed lines in FIG. 8 to the full line correct position 21. The tilting framework 112 is lowered to the FIG. 9 position at which the adhesive coating face of the plate roll 22 engages the printing plate 21 between ends of the table sections 120 and 140. The table section 140 can be withdrawn to the FIG. 10 position at which the table section 140 does not interfere with the printing plate 21 and the plate roll 22 can be turned as shown in FIG. 10 to wrap one end portion of the printing plate 21 around the plate roll 22. Then the direction of rotation can be reversed to complete the winding of the printing plate around the plate roll. Then the plate roll 22 can be removed ready for use in a printing press (not shown).

The machine for mounting a printing plate on a plate roll which has been described above and illustrated in the drawings is subject to structural modification without departing from the spirit and scope of the appended claims.

Having described my invention, what I claim as new and desire to secure by letters patent is:

1. A machine for mounting a printing plate on a plate roll having an adhesive coated face which comprises a frame, means on the frame for rotatably mounting the plate roll in a selected position, a tilting framework swingably mounted on the frame, a pair of table sections mounted on the tilting framework and overlying the plate roll for supporting the printing plate, means on the tilting framework for aligning the printing plate with the plate roll while the printing plate is supported on the table sections, there being a space between the table sections, the tilting framework swinging to a position at which the adhesive coated face of the plate roll engages the printing plate through the space, and means for turning the plate roll to cause the printing plate to engage flatwise the adhesive coated face for causing adhesion of the printing plate to the adhesive coated face in proper registry.

2. A machine as in claim 1 in which one of the table sections is slideably mounted on the tilting framework for removal from the path of the printing plate as the plate roll is turned.

3. A machine as in claim 1 in which the means on the tilting framework for aligning the printing plate with the plate roll includes grid sheet means for overlying the printing plate on the table sections so that the printing plate can be adjusted to aligned position while held in position below the grid sheet means.

4. A machine as in claim 1 in which the means for mounting the plate roll in a selected position includes a rotatable shaft, index disc means mounted to turn with the shaft, latch means for engaging the index disc means to hold the index disc means in selected position, a clutch disc mounted on the shaft for turning therewith, and clutch means on the plate roll engageable by the clutch disc to hold the plate roll in selected position.

* * * * *